US009142875B2

(12) United States Patent
Kim

(10) Patent No.: US 9,142,875 B2
(45) Date of Patent: Sep. 22, 2015

(54) ANTENNA HAVING LINEAR ARRAY ANTENNA UNIT

(75) Inventor: Sung-Min Kim, Gyeonggi-do (KR)

(73) Assignee: KT CORPORATION, Gyeonggi-do (KR)

( * ) Notice: Subject to any disclaimer, the term of this patent is extended or adjusted under 35 U.S.C. 154(b) by 179 days.

(21) Appl. No.: 13/325,110

(22) Filed: Dec. 14, 2011

(65) Prior Publication Data

US 2012/0169567 A1 Jul. 5, 2012

(30) Foreign Application Priority Data

Dec. 29, 2010 (KR) ..... 10-2010-0137409

(51) Int. Cl.

| | |
|---|---|
| ***H01Q 3/00*** | (2006.01) |
| ***H01Q 1/24*** | (2006.01) |
| ***H01Q 3/24*** | (2006.01) |
| ***H01Q 9/22*** | (2006.01) |

(52) U.S. Cl.

CPC ..... *H01Q 1/241* (2013.01); *H01Q 3/24* (2013.01); *H01Q 9/22* (2013.01)

(58) Field of Classification Search

CPC ..... H01Q 3/00
USPC ..... 343/876
See application file for complete search history.

(56) References Cited

U.S. PATENT DOCUMENTS

| | | | | |
|---|---|---|---|---|
| 6,320,549 | B1 | 11/2001 | Nybeck et al. | |
| 6,498,586 | B2 | 12/2002 | Pankinaho | |
| 6,512,493 | B2 | 1/2003 | Park et al. | |
| 6,650,294 | B2 | 11/2003 | Ying et al. | |
| 6,897,830 | B2 | 5/2005 | Bae et al. | |
| 6,963,310 | B2 | 11/2005 | Horita et al. | |
| 7,042,402 | B2 | 5/2006 | Modro | |
| 7,215,288 | B2 | 5/2007 | Park et al. | |
| 7,256,743 | B2 | 8/2007 | Korva | |
| 7,423,593 | B2 | 9/2008 | Puente Baliarda | |
| 7,443,344 | B2 | 10/2008 | Boyle | |
| 7,755,546 | B2 | 7/2010 | Ishimiya | |
| 2007/0080874 | A1* | 4/2007 | Jeon et al. | 343/702 |
| 2009/0231213 | A1 | 9/2009 | Ishimiya | |
| 2011/0175791 | A1* | 7/2011 | Ozdemir et al. | 343/876 |

FOREIGN PATENT DOCUMENTS

| | | | |
|---|---|---|---|
| JP | 8307142 | A | 11/1996 |
| JP | 2003037418 | A | 2/2003 |
| JP | 2003037425 | A | 2/2003 |
| JP | 2004-104419 | A | 4/2004 |
| JP | 2006-203544 | A | 8/2006 |

(Continued)

*Primary Examiner* — Dameon E Levi
*Assistant Examiner* — Andrea Lindgren Baltzell
(74) *Attorney, Agent, or Firm* — IP Legal Services, LLC

(57) ABSTRACT

An antenna may include a linear array antenna unit, a first switch, and a second switch. The linear array antenna unit may be configured to include a plurality of cable elements linearly arranged and coupled to each other. The first switch may include one end coupled to a ground and another end coupled to at least one of the plurality of cable elements of the linear array antenna unit. The second switch may include one end coupled to a power feed point and another end coupled to at least one of the plurality of cable elements. The plurality of cable elements of the linear array antenna unit may form one of a first antenna structure and a second antenna structure according to the switching operations of the first and second switches.

19 Claims, 3 Drawing Sheets

(56) References Cited

FOREIGN PATENT DOCUMENTS

| | | | | |
|---|---|---|---|---|
| JP | 2007-123982 | A | 5/2007 | |
| JP | 2011055466 | A | 3/2011 | |
| JP | 2011066778 | A | 3/2011 | |
| KR | 1020030003647 | A | 1/2003 | |
| KR | 1020030015663 | A | 2/2003 | |
| KR | 1020040003802 | A | 1/2004 | |
| KR | 10-2005-0025903 | A | 3/2005 | |
| KR | 1020050019675 | A | 3/2005 | |
| KR | 1020050034172 | A | 4/2005 | |
| KR | 10-2006-0073093 | A | 6/2006 | |
| KR | 1020060070512 | A | 6/2006 | |
| KR | 10-2007-0025794 | A | 3/2007 | |
| KR | 1020080072404 | A | 8/2008 | |
| KR | 10-2010-0110951 | A | 10/2010 | |
| WO | WO 2010/033779 | A1 * | 3/2010 | ..... H04B 7/00 |

* cited by examiner

ANTENNA HAVING LINEAR ARRAY ANTENNA UNIT

CROSS REFERENCE TO PRIOR APPLICATIONS

The present application claims priority under 35 U.S.C. §119 to Korean Patent Application No. 10-2010-0137409 (filed on Dec. 29, 2010), which is hereby incorporated by reference in its entirety.

FIELD OF THE INVENTION

Apparatuses and methods consistent with the present invention relate to an antenna, and more particularly, to an antenna having a linear array antenna unit.

BACKGROUND OF THE INVENTION

A user equipment has been advanced so as to be able to receive various services such as a communication service including a voice call service and a short message service, and a multimedia service including a streaming service and a digital multimedia broadcasting (DMB) service. In order to support such services, a user equipment is required to have an antenna for receiving corresponding signals. Since the communication services and the multimedia services are provided through different frequency bands, an antenna supporting multiple frequency bands has been demanded.

For example, a DMB service is provided by transmitting a DMB signal that is a low frequency band signal. In order to receive the DMB signal, an external antenna has been generally equipped to a user equipment. For example, a whip antenna is a typical external antenna for receiving a DMB service. The whip antenna may be a retractable antenna.

For example, a communication service including a voice call service and a data service code is provided by transmitting a code division multiple access (CDMA) signal or a wideband code division multiple access (WCDMA) signal. In order to receive such a CDMA signal or WCDMA signal, an internal antenna has been equipped to a user equipment. For example, a planar inverted F antenna (PIFA) or a monopole antenna has been widely used as the internal antenna for receiving such a CDMA signal or WCDMA signal.

The internal antenna provides proper performance for transmitting and receiving a respective signal in a typical environment. The performance of the internal antenna, however, is significantly deteriorated while in a weak electric field region such as in a tunnel.

A dipole antenna, which is known as an external antenna, may provide proper performance for transmitting and receiving a signal even in weak electric field regions. The dipole antenna, however, requires a certain length and width for properly transmitting and receiving a signal. Meaning, the dipole antenna has a comparatively larger size than an internal antenna such as a PIFA and a monopole antenna. Accordingly, due to the required size of the dipole antenna, it is difficult to dispose the dipole antenna inside a user equipment, and portability and user convenience may be degraded. Furthermore, the performance of the dipole antenna is also deteriorated while in a weak electric field region.

SUMMARY OF THE INVENTION

Embodiments of the present invention overcome the above disadvantages and other disadvantages not described above. Also, the present invention is not required to overcome the disadvantages described above, and an embodiment of the present invention may not overcome any of the problems described above.

In accordance with an aspect of the present invention, an antenna having a linear array antenna unit may operate in dual mode according to a surrounding environment and/or to a type of a signal that is received or transmitted.

In accordance with another aspect of the present invention, an antenna having a linear array antenna unit may change an electrical antenna structure of the linear array antenna unit according to a surrounding environment and/or to a type of a signal that is received or transmitted.

In accordance with still another aspect of the present invention, an antenna having a linear array antenna unit may operate as a typical external antenna such as a whip antenna in a first mode, and may operate as a dipole antenna in a second mode.

In accordance with still another aspect of the present invention, an antenna having a linear array antenna unit may provide proper performance for transmitting and receiving a respective signal even in a weak electric field region.

In accordance with an embodiment of the present invention, an antenna may include a linear array antenna unit, a first switch, and a second switch. The linear array antenna unit may be configured to include a plurality of cable elements linearly arranged and coupled to each other. The first switch may include one end coupled to a ground and another end coupled to at least one of the plurality of cable elements of the linear array antenna unit. The first switch may be configured to perform a switching operation for one of connecting and disconnecting the ground and the coupled at least one of the plurality of cable elements according to an operation mode. The second switch may include one end coupled to a power feed point and the other end coupled to at least one of the plurality of cable elements. The second switch may be configured to perform a switching operation for one of connecting and disconnecting the power feed point and the coupled at least one of the plurality of cable elements according to the operation mode. The plurality of cable elements of the linear array antenna unit may form one of a first antenna structure and a second antenna structure according to the switching operations of the first and second switches.

When the operation mode is in a first mode, the first switch may perform a first mode switching operation for disconnecting the ground from the coupled at least one cable element. Furthermore, the second switch may perform the first mode switching operation for connecting the power feed point and the coupled at least one cable element, and the linear array antenna unit may form the first antenna structure for the first mode in response to the first mode switching operations of the first switch and the second switch.

When the operation mode is in a second mode, the first switch may perform a second mode switching operation for connecting the ground and the coupled at least one cable element. Furthermore, the second switch may perform the second mode switching operation for disconnecting the power feed from the coupled at least one cable element, and the linear array antenna unit may form the second antenna structure for the second mode in response to the second mode switching operation of the first switch and the second switch.

The first antenna structure may be an external antenna including a whip antenna and receive a digital multimedia broadcasting (DMB) signal.

The second antenna structure may be a dipole antenna and receive one of a code division multiple access (CDMA) signal and a wideband code division multiple access (WCDMA) signal.

Each one of the plurality of cable elements may include an internal conductor and an external conductor. An external conductor of an $N^{th}$ cable element may be electrically coupled to an internal conductor of an $(N+1)^{th}$ cable element. N denotes a natural number.

Another end of the first switch may be coupled to the external conductor of the $N^{th}$ cable element, another end of the second switch may be coupled to the external conductor of the $N^{th}$ cable element, and an internal conductor of the $N^{th}$ cable element may directly contact the power feed point.

When the operation mode is in the first mode, the first switch may perform a first mode switching operation that disconnects the ground from the external conductor of the $N^{th}$ cable element, the second switch may perform the first mode switching operation that couples the power feed point to the external conductor of the $N^{th}$ cable element, and a power feed signal may be supplied to all internal conductors and external conductors of the N cable elements.

When the operation mode is in the first mode, all of the internal conductors and external conductors of the N cable elements may form a whip antenna structure.

When the operation mode is in the second mode, the first switch may perform a second mode switching operation for coupling the ground and the external conductor of the $N^{th}$ cable element, the second switch may perform the second mode switching operation for disconnecting the power feed from the external conductor of the $N^{th}$ cable element, and a power feed signal may be supplied to the external conductor of the $N^{th}$ cable element and other cable elements coupled to the external conductor of the $N^{th}$ cable element.

The N cable elements form at least one dipole radiator when the operation mode is in the second mode.

The antenna may further include a switch controller configured to generate one of a first mode signal and a second mode signal according to the operation mode and output the generated one of the first mode signal and the second mode signal to the first switch and the second switch. The first switch and the second switch may perform one of the first mode switching operation and the second mode switching operation in response to one of the first mode signal and the second mode signal.

In accordance with another embodiment of the present invention, an antenna may include a switch control unit, a switch unit, and a linear array antenna unit. The switch control unit may be configured to generate one of first and second mode signals according to an operation mode. The switching unit may be configured to perform one of first and second switching operations in response to the generated one of first and second mode signals. The linear array antenna unit may include a plurality of cable elements. The linear array antenna may be configured to form one of first and second antenna structures in response to the one of first and second switching operation.

The switch control unit may generate the first mode signal when the operation mode is in a first mode. The switch control unit may generate the second mode signal when the operation mode is in a second mode.

The switch unit may perform the first switching operation in response to the first mode signal, and the linear array antenna unit may form the first antenna structure by the first switching operation.

The switch unit may perform the second switching operation in response to the second mode signal, and the linear array antenna unit may form the second antenna structure by the second switching operation.

The first switching operation may disconnect a ground from the linear array antenna unit and couples a power feed point to the linear array antenna, and the linear array antenna may form a whip antenna as the first antenna structure by supplying a power feed signal to each one of the plurality of cable elements in response to the first switching operation.

The second switching operation may couple a ground to the linear array antenna unit and disconnect a power feed point from at least one of the plurality of cable elements. The linear array antenna may form at least one dipole radiator as the second antenna structure by selectively supplying a power feed signal to at least one of the plurality of cable elements in response to the second switching operation.

The switch unit may include a first switch and a second switch. The first switch may include one end coupled to a ground and another end coupled to one end of at least one of the plurality of cable elements. The second switch may include one end coupled to a power feed point and another end coupled to the one end of at least one of the plurality of cable elements.

Each one of the plurality of cable elements may include an external conductor and an internal conductor. An external conductor of an $N^{th}$ cable element may be coupled to an internal conductor of an $(N+1)^{th}$ cable element where N is a natural number. An external conductor of a first cable element may have one end coupled to the ground through the first switch and coupled to the power feed point through the second switch. An internal conductor of the first cable element may include one end directly coupled to the power feed point.

BRIEF DESCRIPTION OF THE DRAWINGS

The above and/or other aspects of the present invention will become apparent and more readily appreciated from the following description of embodiments, taken in conjunction with the accompanying drawings, of which.

DETAILED DESCRIPTION OF THE INVENTION

Figure 1:
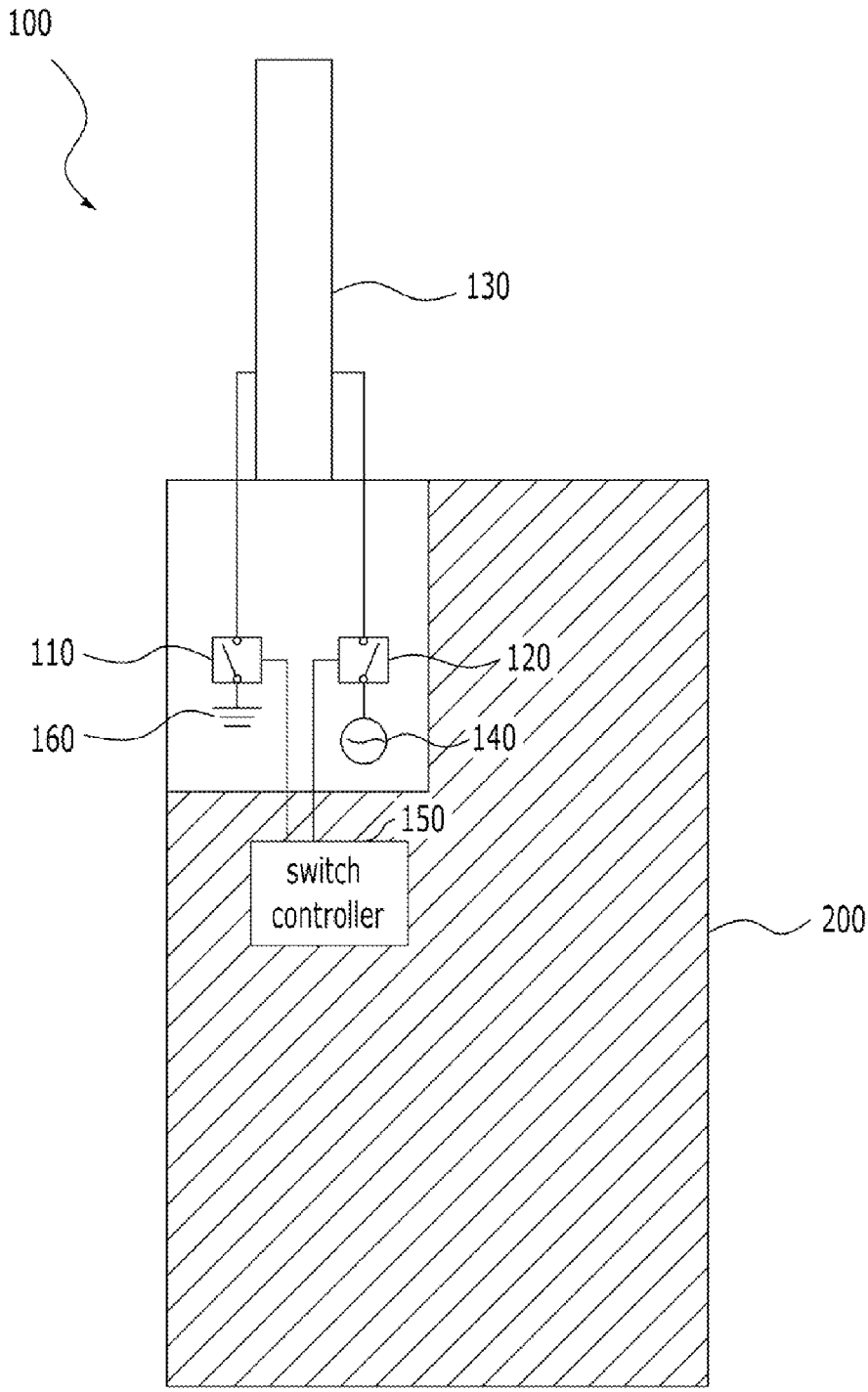
FIG. 1 illustrates an antenna having a linear array antenna unit, in accordance with an embodiment of the present invention.

Reference will now be made in detail to embodiments of the present invention, examples of which are illustrated in the accompanying drawings, wherein like reference numerals refer to like elements throughout. The embodiments are described below, in order to explain the present invention by referring to the figures.

In accordance with an embodiment of the present invention, an antenna having a linear array antenna unit may operate in dual mode according to a surrounding environment and/or to a type of a signal to be received or transmitted. In order to operate in dual mode such as a first mode and a second mode, the antenna may change an electric antenna structure of the linear array antenna unit according to a surrounding environment and/or to a type of a signal to be received or transmitted. For example, the antenna may operate as a whip antenna in a typical environment and/or receive a DMB signal. The antenna may operate as a dipole antenna in a weak electric field region such as within a tunnel. Such an antenna having a linear array antenna unit will be described hereinafter in detail with reference to FIG. 1.

FIG. 1 illustrates an antenna having a linear array antenna unit in accordance with an embodiment of the present invention.

As shown in FIG. 1, an antenna 100 may be installed at a user equipment 200 such as a mobile phone, a smart phone, or a handheld device capable of supporting a communication service and a multimedia service, but the present invention is not limited thereto. The antenna 100 may include a first switch 110, a second switch 120, and a linear array antenna unit 130. The antenna 100 may further include a switch controller 150.

The first and second switches 110 and 120 may be disposed inside the user equipment 200. The first and second switched 110 and 120 may be electrically coupled to the switch controller 150, but the present invention is not limited thereto. The first and second switches 110 and 120 may operate switching operations according to an operation mode, such as a first mode and a second mode, which is decided based on a surrounding environment or a type of signal to be transmitted or received.

Figure 2:
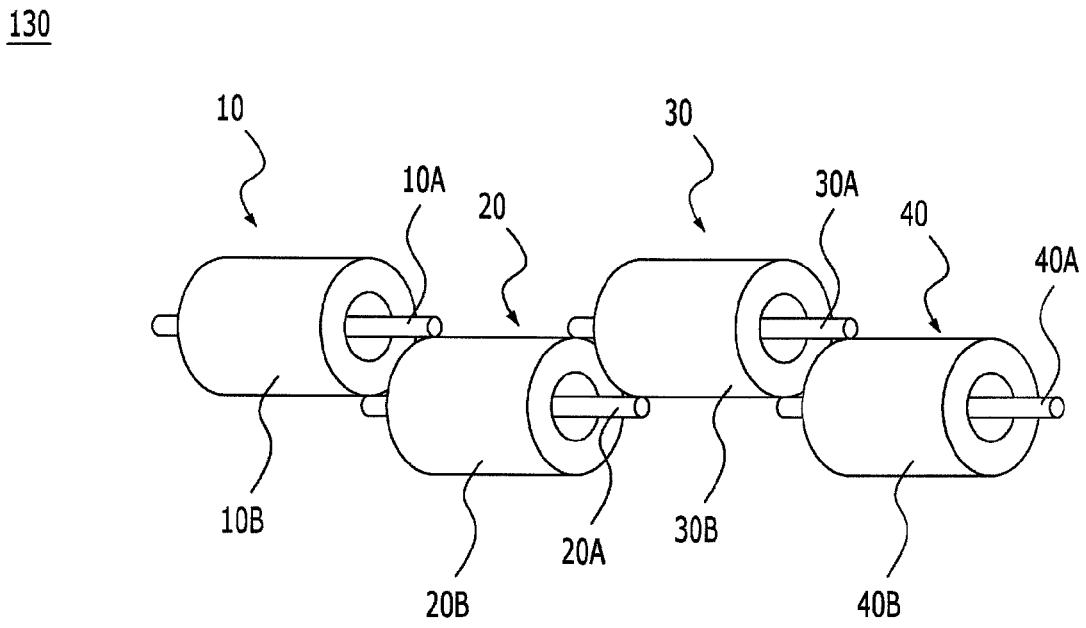
FIG. 2 illustrates a linear array antenna unit in accordance with an embodiment of the present invention.

The first switch 110 may include one end coupled to a ground 130 and another end coupled to one end of the linear array antenna unit 130. Particularly, the another end may be coupled to one end of a first external conductor 10A of the linear array antenna unit 130, as shown in FIG. 2.

The first switch 110 may switch an electric path between the ground 160 and the first external conductor 10A of a first cable element 10 according to an operation mode. For example, when the operation mode is in the first mode, the first switch 110 may be open. Accordingly, the first switch 110 may electrically disconnect the ground 160 from the first external conductor 10A of the first cable element 10. On the contrary, when the operation mode is in the second mode, the first switch 110 may be closed. Accordingly, the first switch 110 may electrically couple the ground 160 with the first external conductor 10A of the first cable element 10. That is, the first switch 110 may form an electrical path between the ground 160 and the first cable element 10.

The second switch 120 may have one end coupled to a power feed point 140 and another end coupled to one end of the linear array antenna unit 130. Particularly, the another end may be coupled to one end of the first external conductor 10A of the linear array antenna unit 130, as shown in FIG. 2.

The second switch 120 may switch an electrical path between the power feed point 140 and the first external conductor 10A of the first cable element 10 according to the operation mode. For example, when the operation mode is in the first mode, the second switch 120 may be closed. Accordingly, the second switch 120 may electrically couple the power feed point 140 to the first external conductor 10A of the first cable element 10. When the operation mode is in the second mode, the second switch 120 may be open. Accordingly, the second switch 120 may electrically disconnect the power feed point 140 form the first external conductor 10A of the first cable element 10.

The first and second switches 110 and 120 may be controlled in response to a control signal from the switch controller 150. The switch controller 150 may generate one of a first mode signal and a second mode signal according to a surrounding environment or a type of a service. The present invention, however, is not limited thereto. The first and second switches 110 and 120 may also be manually controlled by a respective user.

The linear array antenna unit 130 may include a plurality of cable elements 10, 20, 30, and 40, as shown in FIG. 2. The plurality of cable elements 10, 20, 30, and 40 may be linearly arranged and coupled to each other. Such a structure of the linear array antenna unit 130 may be installed at a typical base station. In accordance with an embodiment of the present invention, the linear array antenna unit 130 may be disposed at the user equipment 200 as an antenna for receiving and transmitting signals for various communication services and multimedia services. The structure of the linear array antenna unit 130 will be described in more detail with reference to FIG. 2.

The linear array antenna unit 130 may be extractable to the outside of the user equipment 200 and also insertable to the inside of the user equipment 200. Accordingly, the linear array antenna unit 130 may be extracted to the outside of the user equipment 200 or inserted inside the user equipment 200 according to a type of a signal to be transmitted or received.

The linear array antenna unit 130 may change an electrical antenna structure according to a mode decided based on a surrounding environment or a type of a signal to be transmitted or received. In order to change the electrical structure of the linear array antenna unit 130, the first and second switches 110 and 120 are controlled. The linear array antenna unit 130 may be electrically coupled to the first switch 110 and the second switch 120. The first switch 110 and the second switch 120 may be disposed inside the user equipment 200. The first switch 110 and the second switch 120 may be also electrically coupled to the switch controller 150. The first switch 110 and the second switch 120 may perform switching operations in response to the switch controller 150. According to the switching operation of the first and second switches 110 and 120, the linear array antenna unit 130 may operate in dual modes, such as a first mode and a second mode.

In a first mode, the linear array antenna unit 130 may operate as a typical external antenna such as a whip antenna. In order to control the linear array antenna unit 130 to operate as the external antenna, the first switch 110 may be controlled to be open and the second switch 120 may be controlled to be closed. For example, in the first mode, the linear array antenna unit 130 may have an electrical antenna structure that may receive a DMB signal.

In a second mode, the linear array antenna unit 130 may operate as a dipole antenna. That is, a plurality of cable elements of the linear array antenna unit 130 may operate as at least one dipole radiator in the second mode. In order to control the linear array antenna unit 130 to operate in the second mode, the first switch 110 may be controlled to be closed and the second switch 120 may be controlled to be open. For example, in the second mode, the linear array antenna unit 130 may have an electric antenna structure proper for transmitting and receiving a voice call signal in a weak electric field region. The voice call signal may include a CDMA signal, a WCDMA signal, and/or a personal communication service (PCS) signal.

FIG. 2 illustrates a linear array antenna unit in accordance with an embodiment of the present invention.

Referring to FIG. 2, the linear array antenna unit 130 may include a plurality of cable elements 10, 20, 30, and 40. Particularly, the linear array antenna unit 130 may include a first cable element 10, a second cable element 20, a third cable element 30, and a fourth cable element 40. Although FIG. 2 illustrates the linear array antenna unit 130 to include four cable elements, the present invention is not limited thereto. In accordance with another embodiment of the present invention, the linear array antenna unit 130 may include more than or less than four cable elements.

The first to fourth cable elements 10 to 40 may include external conductors 10A, 20A, 30A, and 40A, and internal conductors 10B, 20B, 30B, and 40B, respectively. For example, the first cable element 10 may include a first internal conductor 10A and a first external conductor 10B. The second cable element 20 may include a second internal conductor 20A and a second external conductor 20B.

The plurality of cable elements 10, 20, 30, and 40 may be electrically coupled to each other. For example, an internal conductor of an $N^{th}$ cable element may be electrically coupled with an external conductor of an $(N+1)^{th}$ cable element. Furthermore, an external conductor of an $N^{th}$ cable element may be electrically coupled with an internal conductor of an $(N+1)^{th}$ cable element. Herein, N denotes a natural number.

For example, a first internal conductor 10A of the first cable element 10 may be electrically coupled with the second external conductor 20B of the second cable element 20. The first external conductor 10B of the first cable element 10 may be electrically coupled with the second internal conductor 20A of the second cable element 20.

Such a coupling structure of the first and second cable elements may be similarly applied to other cable elements including the third cable element 30 and fourth cable element 40. For example, the second internal conductor 20A of the second cable element 20 may be electrically coupled with the third external conductor 30B of the third cable element 30, and the second external conductor 20B of the second cable element 20 may be electrically coupled with the third internal conductor 30A of the third cable element 30. The third internal conductor 30A of the third cable element 30 may be electrically coupled with the fourth external conductor 40B of the fourth cable element 40, and the third external conductor 30B of the third cable element 30 may be electrically coupled with the fourth internal conductor 40A of the fourth cable element 40.

Such a structure of the linear array antenna unit 130 may form different electrical antenna structures according to operation modes. For example, in the first mode, the plurality of cable elements 10, 20, 30, and 40 of the linear array antenna 130 may form an external antenna such as a whip antenna in response to a first mode switching operation of the first and second switches 110 and 120. In the second mode, the plurality of cable elements 10, 20, 30, and 40 of the linear array antenna 130 may form at least one dipole radiator in response to a second mode switching operation of the first and second switches 110 and 120. Such an electric antenna structure of the linear array antenna unit 130 and the first and second mode switching operations will be described, in more detail, with reference to FIG. 3.

Figure 3:
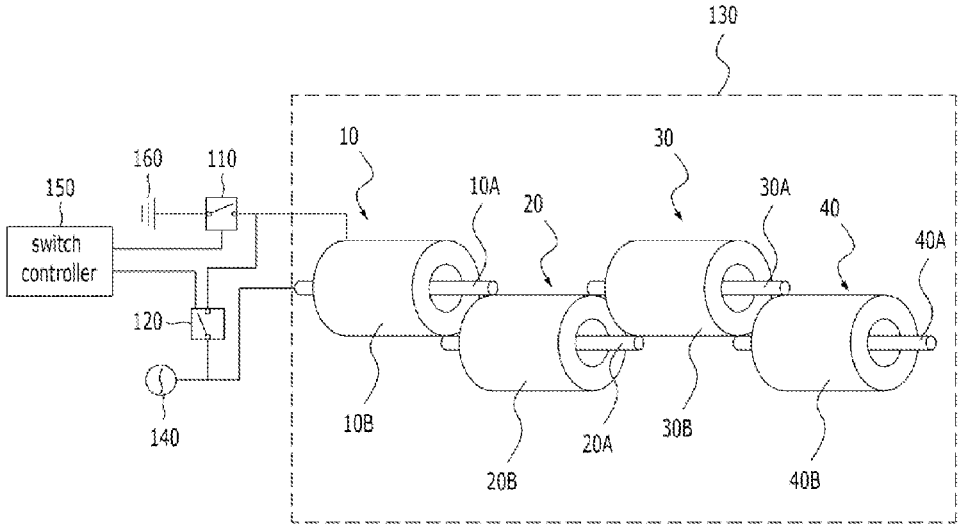
FIG. 3 illustrates a plurality of cable elements of a linear array antenna unit, coupled to first and second switches, in accordance with an embodiment of the present invention.

FIG. 3 illustrates a plurality of cable elements of a linear array antenna unit, coupled to first and second switches, in accordance with an embodiment of the present invention.

Referring to FIG. 3, the first switch 110 may be disposed between the ground 160 and the first external conductor 10B of the first cable element 10. Particularly, one end of the first switch 110 may be coupled to the ground 160, and another end thereof may be coupled to the first external conductor 10B of the first cable element 10. Such a first switch 110 may switch an electrical path between the first external conductor 10B and the ground 160 according to a switching operation of the first switch 110.

The second switch 120 may be disposed between the power feed point 140 and the first external conductor 10B of the first cable element 10. Particularly, one end of the second switch 110 may be electrically coupled to the power feed point 140 and another end of the second switch 110 may be electrically coupled to the external conductor 10B of the first cable element 10. The second switch 120 may switch an electrical path between the power feed point 140 and the external conductor 10B of the first cable element 10.

In the first mode, the first switch 110 may be controlled to be open and the second switch 120 may be controlled to be closed. Such a first mode switching operation may cause the electrical path between the first external conductor 10B and the ground 160 to be disconnected because the first switch is open. Furthermore, the first mode switching operation may also cause the first external conductor 10B to be electrically coupled to the power feed point 140 because the second switch 120 is closed.

As a result of the first mode switching operation, a power feed signal may be supplied to both of the first external conductor 10B and the first internal conductor 10A in the first mode. Accordingly, the power feed signal may be also supplied to all internal and external conductors 10A, 10B, 20A, 20B, 30A, 30B, 40A, and 40B of the cable elements 10, 20, 30, and 40 of the linear antenna array unit 130. Therefore, the plurality of cable elements 10, 20, 30, and 40 may form a structure of an external antenna such as a whip antenna.

That is, the linear array antenna 130 may operate as a typical external antenna such as a whip antenna in the first mode. For example, the linear array antenna 130 can operate as a DMB antenna in the first mode.

In the second mode, the first switch 110 may be controlled to be closed and the second switch 102 may be controlled to be open. As the first switch 110 is closed, the first external conductor 10B may be electrically coupled to the ground 160, and the first internal conductor 10A may only be electrically coupled to the power feed point 140.

Such a second mode switching operation may cause the first cable element to be electrically coupled to the ground 160 because the first switch 110 is closed. Furthermore, the second mode switching operation may cause only the second external conductor 20B of the second cable element to be electrically coupled with the first internal conductor 10A. Accordingly, the second external conductor 20B may be electrically coupled with the power feed point 140 and the second internal conductor 20A of the second cable element may be electrically coupled with the ground 160. Accordingly, the second cable element may be coupled with the power feed point 140.

That is, the second mode switching operation may cause the first cable element 10 and the second cable element 20 to operate as a dipole radiator as the first cable element 10 is coupled with the ground 160 and the second cable element 20 is coupled with the power feed point 140.

In a similar manner, the third cable element 30 may be coupled with the ground 160, and the fourth cable element 40 may be coupled with the power feed point 140. Accordingly, the second mode switching operation may cause the third and fourth cable elements 30 and 40 to operate as another dipole radiator.

As described above, the linear array antenna unit 130 may form at least one dipole radiator in the second mode. Such a structure of the linear array antenna unit 130 can enable proper transmission and reception of a signal even in a weak electric field region. For example, when transmitting or receiving a signal through the antenna 100 becomes unstable in a weak electric field region, the plurality of cable elements of the linear array antenna unit 130 form at least one dipole radiator through the second mode switching operation. Accordingly, the antenna 100 can transmit and receive a voice call signal and a data communication signal properly even in a weak electric field region.

The first and second switches 110 and 120 may be controlled in response to a control signal from the switch controller 150. The switch controller 150 may generate one of a first mode signal and a second mode signal according to a surrounding environment or a type of a service. For example, the switch controller 150 may generate the first mode signal when an operation mode is the first mode. Particularly, the switch controller 150 may generate the first mode signal when the surrounding environment is a typical environment and/or when a user wants to have a DMB service, which are common scenarios for the first mode. In response to the first mode signal, the first and second switches 110 and 120 may perform the first mode switching operation. That is, the first switch 110 may be opened and the second switch 120 may be closed in response to the first mode signal from the switch controller 150. The present invention, however, is not limited thereto. The first and second switches 110 and 120 may be manually controlled by a user.

As described above, the antenna 100 in accordance with an embodiment of the present invention may control an electrical antenna structure of the linear array antenna unit 130 according to a surrounding environment and/or to a service type. Particularly, the antenna 100 may control an electrical antenna structure of the linear array antenna unit 130 to be formed of at least one dipole radiator when a surrounding environment is a weak electric field region. Accordingly, the antenna 100 in accordance with an embodiment of the present invention can properly perform a signal transmitting and receiving operation even in the weak electric field region.

The term "coupled" has been used throughout to mean that elements may be either directly connected together or may be coupled through one or more intervening elements.

Although embodiments of the present invention have been described herein, it should be understood that the foregoing embodiments and advantages are merely examples and are not to be construed as limiting the present invention or the scope of the claims. Numerous other modifications and embodiments can be devised by those skilled in the art that will fall within the spirit and scope of the principles of this disclosure, and the present teaching can also be readily applied to other types of apparatuses. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An antenna comprising:

a linear array antenna unit configured to include a plurality of cable elements linearly arranged so as to extend linearly with respect to one another, wherein each of the plurality of cable elements is electrically coupled to adjacent cable elements;

a first switch having one end coupled to a ground and another end coupled to at least one cable element of the plurality of cable elements of the linear array antenna unit, and configured to perform a switching operation to connect or disconnect the ground with the at least one cable element of the plurality of cable element according to an operation mode; and a second switch having one end coupled to a power feed point and another end coupled to the at least one cable element of the plurality of cable elements, and configured to perform a switching operation to connect or disconnect the power feed point with the at least one cable element of the plurality of cable elements according to the operation mode, wherein the plurality of cable elements of the linear array antenna unit forms one of a first antenna structure and a second antenna structure according to the switching operations of the first and second switches, wherein each one of cable elements includes an external conductor formed in a shape of a hollow cylinder having an inside wall formed around and along a center axis and an internal conductor positioned inside the external conductor along the center axis and separated from the inside wall of the external conductor within a predetermined distance, and wherein an external conductor of an $N^{th}$ cable element is electrically coupled to at least one of an internal conductor of an $(N+1)^{th}$ cable element and an internal conductor of an $(N-1)^{th}$ cable element, wherein N denotes a natural number.

2. The antenna of claim 1, wherein when the operation mode is in a first mode:

the first switch performs a first mode switching operation for disconnecting the ground from the at least one cable element;

the second switch performs the first mode switching operation for coupling the power feed point and the at least one cable element; and the linear array antenna unit forms the first antenna structure for the first mode in response to the first mode switching operation of the first and second switches.

3. The antenna of claim 1, wherein when the operation mode is in a second mode:

the first switch performs a second mode switching operation for coupling the ground and the at least one cable element;

the second switch performs the second mode switching operation for disconnecting the power feed from the at least one cable element; and the linear array antenna unit forms the second antenna structure for the second mode in response to the second mode switching operation of the first and second switches.

4. The antenna of claim 1, wherein the first antenna structure is an external antenna including a whip antenna and receives a digital multimedia broadcasting (DMB) signal.

5. The antenna of claim 1, wherein the second antenna structure is a dipole antenna and receives one of a code division multiple access (CDMA) signal and a wideband code division multiple access (WCDMA) signal.

6. The antenna of claim 1, wherein:

the another end of the first switch is coupled to the external conductor of the $N^{th}$ cable element;

the another end of the second switch is coupled to the external conductor of the $N^{th}$ cable element; and an internal conductor of the $N^{th}$ cable element is coupled directly to the power feed point.

7. The antenna of claim 6, wherein when the operation mode is in the first mode:

the first switch performs a first mode switching operation that disconnects the ground from the external conductor of the $N^{th}$ cable element;

the second switch performs the first mode switching operation that couples the power feed point to the external conductor of the $N^{th}$ cable element; and a power feed signal is supplied to all internal conductors and external conductors of the N cable elements.

8. The antenna of claim 7, wherein the all internal conductors and external conductors of the N cable elements together form a whip antenna structure.

9. The antenna of claim 6, wherein when the operation mode is in the second mode:

the first switch performs a second mode switching operation for coupling the ground and the external conductor of the $N^{th}$ cable element;

the second switch performs the second mode switching operation for disconnecting the power feed from the external conductor of the $N^{th}$ cable element; and a power feed signal is supplied to the external conductor of the $N^{th}$ cable element and other cable elements coupled to the external conductor of the $N^{th}$ cable element.

10. The antenna of claim 9, wherein the N cable elements form at least one dipole radiator.

11. The antenna of claim 1, further comprising:

a switch controller configured to generate one of a first mode signal and a second mode signal according to the operation mode, and output the generated one of the first mode signal and the second mode signal to the first switch and the second switch, wherein the first switch and the second switch perform one of the first mode switching operation and the second mode switching operation in response to the one of the first mode signal and the second mode signal output by the switch controller.

12. An antenna comprising:

a switch control unit configured to generate one of first and second mode signals according to an operation mode;

a switching unit configured to perform one of first and second switching operations in response to the generated one of first and second mode signals; and a linear array antenna unit comprising a plurality of cable elements linearly arranged so as to extend linearly with respect to one another, configured to form one of first and second antenna structures in response to the one of the first and second switching operations performed by the switching unit, wherein each of the plurality of cable elements is electrically coupled to adjacent cable elements, wherein each one of cable elements includes an external conductor formed in a shape of a hollow cylinder having an inside wall formed around and along a center axis and an internal conductor positioned inside the external conductor along the center axis and separated from the inside wall of the external conductor within a predetermined distance, and wherein an external conductor of an $N^{th}$ cable element is electrically coupled to at least one of an internal conductor of an $(N+1)^{th}$ cable element and an internal conductor of an $(N-1)^{th}$ cable element, wherein N denotes a natural number.

13. The antenna of claim 12, wherein:

the switch control unit generates the first mode signal when the operation mode is in a first mode; and the switch control unit generates the second mode signal when the operation mode is in a second mode.

14. The antenna of claim 13, wherein:

the switch unit performs the first switching operation in response to the generation of the first mode signal; and the linear array antenna unit forms the first antenna structure by the first switching operation.

15. The antenna of claim 14, wherein:

the first switching operation disconnects a ground from the linear array antenna unit and couples a power feed point to the linear array antenna; and the linear array antenna forms a whip antenna as the first antenna structure by supplying a power feed signal to each one of the plurality of cable elements in response to the first switching operation.

16. The antenna of claim 13, wherein:

the switch unit performs the second switching operation in response to the generation of the second mode signal; and the linear array antenna unit forms the second antenna structure by the second switching operation.

17. The antenna of claim 16, wherein:

the second switching operation couples a ground to the linear array antenna unit and disconnects a power feed point from at least one of the plurality of cable elements; and the linear array antenna forms at least one dipole radiator as the second antenna structure by selectively supplying a power feed signal to at least one of the plurality of cable elements in response to the second switching operation.

18. The antenna of claim 13, wherein the switch unit comprises:

a first switch having one end coupled to a ground and another end coupled to one end of at least one of the plurality of cable elements; and a second switch having one end coupled to a power feed point and another end coupled to the one end of at least one of the plurality of cable elements.

19. The antenna of claim 18, wherein:

one end of an external conductor of a first cable element is coupled to the ground through the first switch and coupled to the power feed point through the second switch; and one end of an internal conductor of the first cable element is directly coupled to the power feed point.

* * * * *